United States Patent [19]

Heiss

[11] 4,044,938

[45] Aug. 30, 1977

[54] WIRE COIL GUIDING DEVICE FOR WIRE TREATMENT APPARATUS

[75] Inventor: Wolfgang Heiss, Schaffhausen, Switzerland

[73] Assignee: Georg Fischer Aktiengesellschaft, Schaffhausen, Switzerland

[21] Appl. No.: 683,041

[22] Filed: May 5, 1976

[30] Foreign Application Priority Data

May 20, 1975 Switzerland ..... 6455/75

[51] Int. Cl.[2] ..... B65H 51/02; B61F 23/00

[52] U.S. Cl. ..... 226/168; 140/2

[58] Field of Search ..... 226/108, 111, 119, 168, 226/188; 242/82, 83, 79, 42.01; 140/2; 266/106

[56] References Cited

U.S. PATENT DOCUMENTS

| | | | |
|---|---|---|---|
| 1,607,675 | 11/1926 | Jefferies | 242/47.01 X |
| 3,439,851 | 4/1969 | Rum et al. | 226/168 X |
| 3,500,877 | 3/1970 | Lingen et al. | 226/168 UX |

FOREIGN PATENT DOCUMENTS

| | | | |
|---|---|---|---|
| 937,929 | 2/1956 | Germany | 226/168 |
| 197,494 | 9/1967 | U.S.S.R. | 226/168 |

*Primary Examiner*—Robert W. Saifer

*Attorney, Agent, or Firm*—Toren, McGeady and Stanger

[57] ABSTRACT

A device for guiding wire coils is provided at wire treatment apparatus, particularly a jet descaling machine, the device including a rotating horizontal carrier shaft having the coils of wires suspended therefrom and imparting to the coils rotative movement about the shaft to transport the coils relative to the jet descaling machine in a direction generally parallel to the axis of the carrier shaft. A guide disc device including at least one guide disc is positioned on both sides of the carrier shaft and the guide discs of each of the guide disc devices is freely rotatable about a rotational axis of the disc arranged to extend generally parallel to the direction of transport of the wire coils. The wire coil guiding device may be provided at the inlet side of the machine in order to retard or hold back the windings of a wire bundle suspended from the rotating carrier shaft as the wire is being introduced into the machine and, with respect to machines where the windings are to be again collected together to form a bundle at the discharge end of the machine, the wire coil guiding device may also be provided on the exit side of the machine.

8 Claims, 6 Drawing Figures

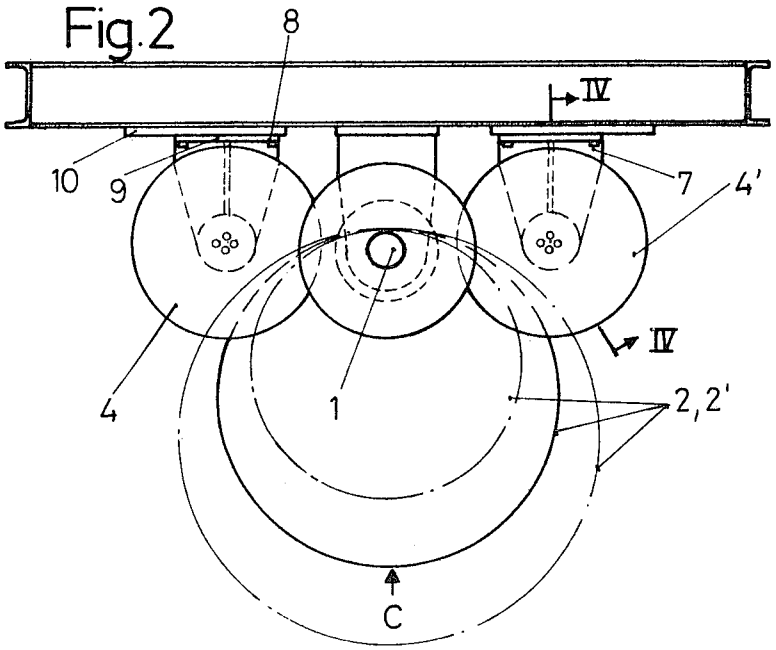
Fig.2
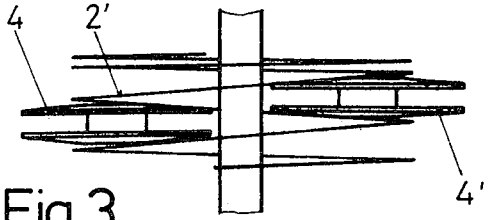
Fig.3
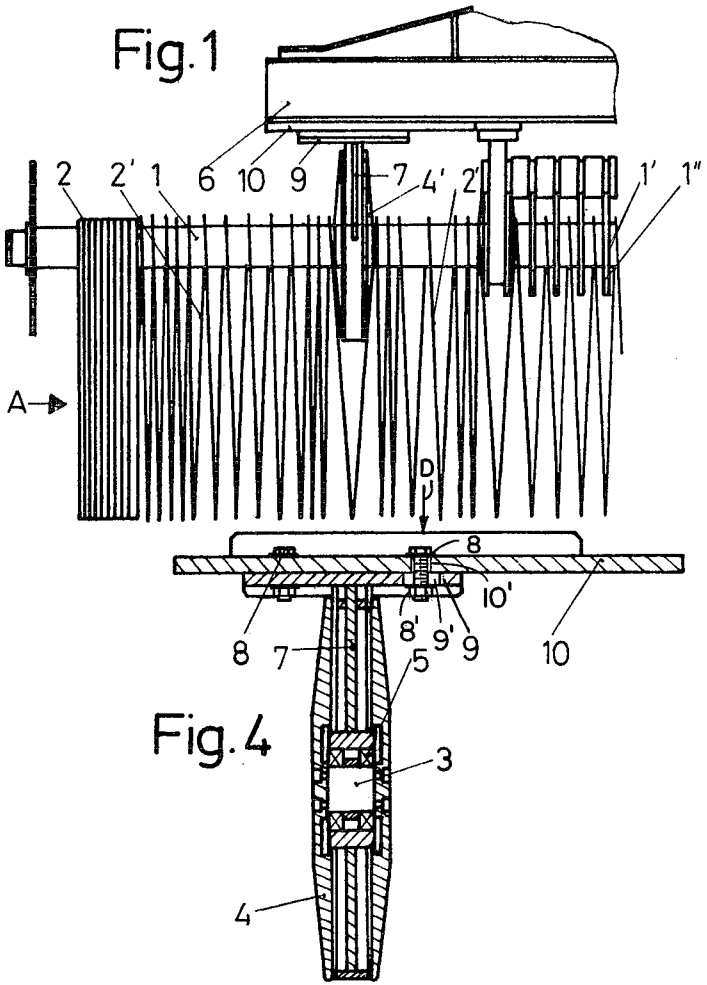
Fig.1
Fig.4

WIRE COIL GUIDING DEVICE FOR WIRE TREATMENT APPARATUS

BACKGROUND OF THE INVENTION

The present invention relates generally to a device for guiding coils of wire and is, more particularly, directed to an arrangement or device applied at machines for the surface treatment of wire, specifically jet descaling machines. The invention operates to hold back or retard the windings of a wire bundle which is suspended from a rotating, horizontal supporting shaft and is located in front of the inlet into the machine. With respect to machines behind which the windings are again to be collected together to form a bundle or bunch, the invention also provides a device which becomes effective at the discharge end of the machine. The device of the invention causes the wire windings to form a fan-like formation and to guide their transport to and from the machine while turning or rotating about a center point.

Wire jet descaling machines have previously been proposed wherein wire is transported in the form of windings from a wire bundle through the jet chamber of the machine in a screwlike or helical form while being suspended from a cam or pinion shaft. In order that the individual windings of the coiled wire become disengaged or removed from the bundle of wire in a clean or unobstructed manner, arrangements or devices are required for holding back or retarding the movement of the windings. German Pat. No. 15 27 789 discloses an arrangement wherein the windings are held back or retarded and are caused to form a fan formation by an inclined separating rod or by an inclined oblong roll or roller which engages the windings.

In prior art devices such as the one mentioned above, such separating rods have the disadvantage that a relatively small diameter of the stationary or fixed rod facilitates friction with the wire. The same disadvantages apply to roller rods. An additional disadvantage involves the fact that the possibility of adjusting such rods for wire bundle diameters of different size is extremely limited. Moreover, the diameter of the rods and the rod rollers cannot be very large inasmuch as the rollers or rods should not become clamped between the individual wire turns or coils but should, instead, be capable of developing some degree of "play" so that they may turn freely. The danger of clamping is particularly great with wire bundles which have small diameters with a small pitch of the screw-like wire turns or coils when, at the same time, the wire has a relatively large diameter.

The object of the present invention is generally to provide an improved arrangement for guiding the coils of wire to and from machines of the aforementioned type and to enable assembly of a machine wherein the aforementioned disadvantages are eliminated or avoided.

SUMMARY OF THE INVENTION

Briefly, the present invention may be described as a device for guiding coils of wire through wire treatment apparatus, particulary jet descaling machines, comprising a rotating horizontal carrier shaft having the coils of wire suspended therefrom and imparting to the coils rotative movement about the carrier shaft in order to transport the coils relative to the treatment apparatus in a direction generally parallel to the axis of the carrier shaft. More specifically, the invention is particularly directed to the provision of guide disc means which include essentially at least one guide disc positioned on both sides of the carrier shaft with each of the guide discs being freely rotatable about a rotational axis of the disc arranged to extend generally parallel to the direction of transport of the wire coils.

The guide disc means may comprise guide disc devices each of which may include a pair of guide discs rotatably mounted thereon with each of the guide disc devices including a bearing block and a common shaft having the discs mounted thereto. The guide disc devices are mounted to be movably adjusted both in the axial and radial directions of the carrier shaft by arranging the bearing block to be movably mounted in the indicated manner. The guide discs mounted upon the common shafts of the bearing blocks may each have opposed faces having a generally conical configuration so that the guide disc device has a tapering shape with the thickness of the guide disc device diminishing in a direction radially outwardly of the device.

The wire coil guiding device of the invention may be located at the entry end of a jet descaling machine in order to hold back or retard the windings of the wire bundles as they move into the machine, and in machines where the windings are again to be collected into a bundle after having passed through the machine, the wire coil guiding device of the invention may also be provided at the exit side of the machine.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a side elevation of an embodiment of the present invention shown located at the inlet or feeding side of a wire descaling machine;

FIG. 2 is an end view of the arrangement of FIG. 1 as viewed in the direction of the arrow A of FIG. 1;

FIG. 3 is a fragmentary or partial schematic elevation of the device depicted in FIG. 2 as viewed from below in the direction indicated by the arrow C;

FIG. 4 is a sectional view taken along the line IV-IV of FIG. 2 shown on an enlarged scale;

DETAILED DESCRIPTION OF THE PREFERRED EMBODIMENTS

Figure 5:
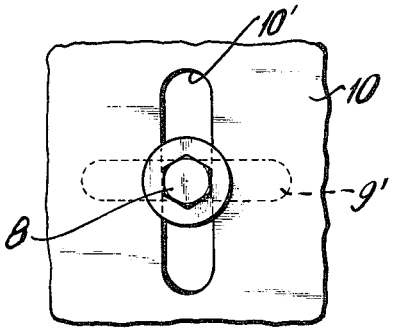
FIG. 5 is a partial plan view of FIG. 4 looking in the direction of the arrow D.

Referring now to the drawing, the device of the present invention is shown located at the inlet or feeding side of a wire descaling machine 6 wherein wire coils formed in bundles are passed from left to right as viewed in FIG. 1 into the wire treatment apparatus or descaling machine. The wire coil guiding device of the invention comprises a supporting or carrier shaft 1, which includes an extension portion thereof formed as a cam shaft 1' having cam discs 1'' thereon. In FIG. 1 there is also depicted the wire bundle 2 which is to be unwound as the wire is moved into the wire treatment apparatus, the wire bundle having individual wire turns, coils or lays 2'.

The device of the present invention also includes guide disc means which comprise a pair of guide disc devices 4, 4' each including two guide discs and arranged upon an adjustable bearing block 7. The bearing blocks 7 include base plates 9 and are secured at a carrier or supporting plate 10 by means of screws 8. The arrangement securing the bearing blocks 7 is such as to enable the bearing blocks to be adjustably moved relative to the supporting or carrier shaft both axially and radially thereof. Such an arrangement may, in a manner known to those skilled in the art, comprise, by way of example, oblong holes extending perpendicularly to each other enabling relative displacement between the plates 9 and 10 in appropriate directions.

As best shown in FIGS. 4 and 5, oblong holes 9' and 10' may be provided in plates 9 and 10, respectively, to permit the requisite adjustment of the blocks 7 by movement of screws 8.

As will be best seen from FIGS. 2 and 3, guide disc devices 4 and 4' comprising double discs are arranged on both sides of the carrier shaft 1 with the arrangement being such that the guide disc devices are offset relative to each other in an axial direction of the shaft.

FIG. 4 depicts a sectional view taken through a guide disc device which comprises a double or twin guide disc 4, which by means of a roller bearing 5 is arranged so as to be freely rotatable on the bearing block 7.

Preferably, in each case, at least one guide disc 4 is arranged on both sides of the bearing block 7 upon a common shaft 3 having both the discs mounted thereupon whereby the wire turns, coils or lays will not come into contact with the stationary bearing block 7.

The thickness of the guide disc devices 4, 4' diminishes or decreases from a point radially inwardly thereof toward the radially outer portion of the device so that the wire winding will bear against a cone shaped end face of the guide discs without deformation and in order to cause rotation of the latter with small friction.

At the exit or discharge side of the wire descaling machine, in the event that the wire is once again to be rolled up to form a bundle, the same arrangement as is provided at the inlet side corresponding to the arrangement shown in FIG. 1 is provided. Thus, it will be apparent that the device depicted in FIG. 1 represents a coil guiding device which may be positioned either at the inlet side or the outlet side of a wire descaling machine, with the device at one side being merely arranged in mirror image to the device at the opposite side.

Figure 6:
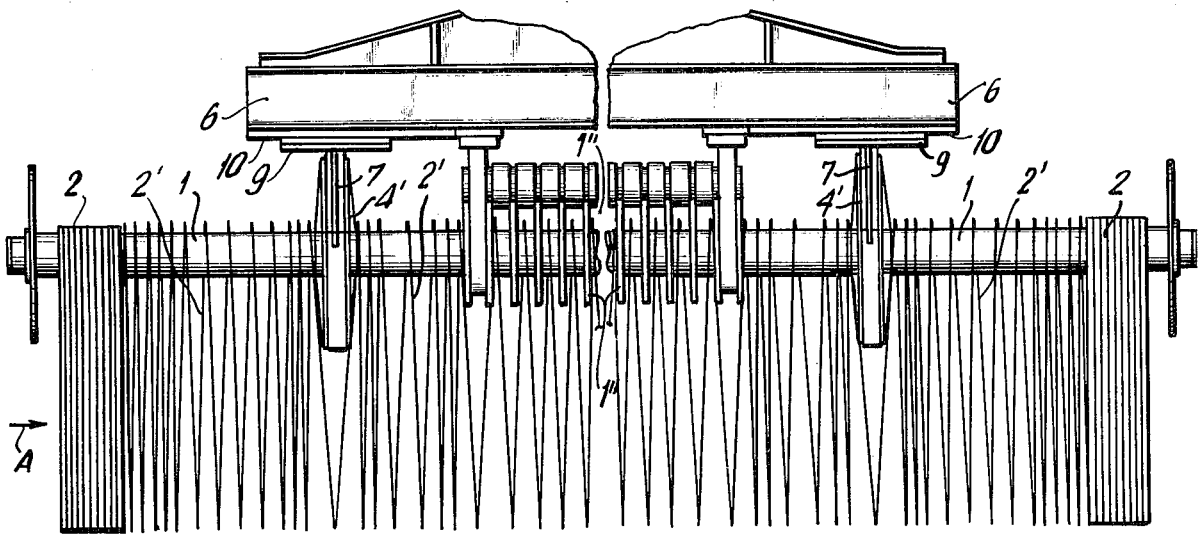
FIG. 6 is a side elevation showing both the inlet and outlet sides of a wire descaling machine according to the invention.

The device disclosed above in its operation will have a wire bundle 2 lying upon the rotating supporting or carrier shaft 1. The carrier shaft 1 imparts to the wire bundle 2 and to the released or discharged wire turns or coils 2', in a known manner, a circular rolling off movement. The wire will form a screw or helical line and will be conveyed by means of the cam discs 1'' on the rotating cam shaft 1' through the machine or through the jet chamber or space thereof. In accordance with the invention, there will be arranged on both sides of the supporting shaft 1, in front of the entrance of the jet machine, guide disc devices 4, 4' each comprising a double guide disc arrangement. In the event that the wire is to be wound into a bundle after the wire has passed through the jet machine, a similar arrangement is also provided adjacent the exit side of the machine. FIG. 6 shows such an arrangement, with the inlet side shown on the left and the outlet or exit side shown on the right. When the double-disc guide disc devices 4 and 4' are suitably adjusted relative to the wire ring diameter and the diameter of the wire proper, the guide disc devices 4 and 4' will effect an orderly release of the individual wire turns 2' from the bundle 2. In this manner, a uniform, orderly feeding or insertion onto the cam shaft 1' and into the jet machine of the wire will be assured.

At the same time, the wire bundle 2 will be retarded or held back away from the cam shaft 1' by the double-disc guide disc devices 4 and 4'. Furthermore, a certain return movement of the released wire turns 2'' will occur which in turn will cause a desirable loosening-up of the wire bundle 2. In order to obtain in each case the most favorable conditions for proper and satisfactory functioning of the guide disc devices, the latter, as already described, may be adjusted or set both in the axial direction and also in the radial direction relative to the supporting shaft 1. Due to this adjustment possibility, wire bundle diameters which fluctuate in a wide range may be supplied to the cam shaft 1' without difficulty and with a minimum of friction while avoiding any deformations.

While specific embodiments of the invention have been shown and described in detail to illustrate the application of the inventive principles, it will be understood that the invention may be embodied otherwise without departing from such principles.

What is claimed is:

1. A device for guiding coils of wire through wire treatment apparatus, particularly jet descaling machines, comprising a rotating horizontal carrier shaft having said coils of wire suspended therefrom and imparting to said coils rotative movement about said shaft to transport said coils relative to said treatment apparatus in a direction generally parallel to the axis of said shaft, and guide disc means including at least one guide disc positioned on both sides of said carrier shaft, each of said guide discs being freely rotatable about a rotational axis of the disc arranged to extend generally parallel to the direction of transport of the wire coils.

2. A device according to claim 1, wherein said jet descaling machine includes an entry end through which said wire coils are introduced into said machine and wherein said device for guiding said coils is located at said entry end.

3. A device according to claim 2, wherein said jet descaling machine includes an exit end where said wire coils are collected into a bundle after having passed through said machine, and wherein said device for guiding said coils is also arranged at said exit end of said machine.

4. A device according to claim 1, wherein said guide disc means include a bearing block having a common shaft thereon, and a pair of guide discs mounted at both sides of said bearing block upon said common shaft.

5. A device according to claim 1 including means mounting said guide disc means to enable adjustable movement of the position thereof both axially and radially of said carrier shaft.

6. A device according to claim 1, wherein said guide discs comprise a generally conical configuration.

7. A device according to claim 1, wherein said guide disc means include a guide disc device positioned on both sides of said carrier shaft each having a pair of guide discs mounted thereon freely rotatable about a common axis, each of said guide discs having a side with a generally conical configuration and being mounted with said conical sides facing in opposed directions to form said guide disc device with a thickness dimension which decreases from said common axis radially outwardly of said guide disc device.

8. A device according to claim 7, where said guide disc device comprises a bearing block having a common shaft defining said common axis of rotation of said guide discs and having both said guide discs mounted thereon, said bearing block being adjustably mounted relative to said wire treatment apparatus to enable adjustable positioning of said guide disc device both radially and axially of said carrier shaft.

* * * * *